US006245270B1

(12) United States Patent
Mizutani et al.

(10) Patent No.: US 6,245,270 B1
(45) Date of Patent: Jun. 12, 2001

(54) PROCESS FOR THE PRODUCTION OF POROUS POLYOLEFIN

(75) Inventors: Yukio Mizutani; Satoshi Nagou, both of Tokuyama (JP)

(73) Assignee: Tokuyama Corporation, Tokuyama (JP)

( * ) Notice: Subject to any disclaimer, the term of this patent is extended or adjusted under 35 U.S.C. 154(b) by 0 days.

(21) Appl. No.: 09/381,223

(22) PCT Filed: Mar. 16, 1998

(86) PCT No.: PCT/JP98/01100

§ 371 Date: Sep. 17, 1999

§ 102(e) Date: Sep. 17, 1999

(87) PCT Pub. No.: WO98/41572

PCT Pub. Date: Sep. 24, 1998

(30) Foreign Application Priority Data

Mar. 17, 1997 (JP) ..... 9-062563

(51) Int. Cl.[7] ..... B29C 67/20; D01D 5/247

(52) U.S. Cl. ..... 264/154; 264/210.5; 264/210.6; 264/210.7; 264/210.8; 264/211.13; 264/211.14; 264/235.6; 264/235.8; 264/288.8

(58) Field of Search ..... 264/41, 129, 154, 264/210.5, 210.6, 210.7, 210.8, 211.13, 211.14, 235.6, 235.8, 288.8, 469, 564

(56) References Cited

U.S. PATENT DOCUMENTS 5,015,521 * 5/1991 Fujii et al. ..... 428/220

FOREIGN PATENT DOCUMENTS

| | | |
|---|---|---|
| 7289829A | 11/1995 | (JP) . |
| 9157943A | 6/1997 | (JP) . |
| 9157944A | 6/1997 | (JP) . |
| 1-293102 | 11/1997 | (JP) . |
| 63-108041 | 5/1998 | (JP) . |

OTHER PUBLICATIONS

Nagó, Satoshi et al. *J. of Applied Polymer Sci.*, vol. 62, pp. 81–86, (1996).

Nagó, Satoshi et al. *J. of Applied Polymer Sci.*, vol. 61, pp. 2355–2359, (1996).

Mizutani, Yukio et al. *Ind. Eng. Chem. Res.*, vol. 32, pp. 221–227 (1993).

* cited by examiner

*Primary Examiner*—Leo B. Tentoni
(74) *Attorney, Agent, or Firm*—Birch, Stewart, Kolasch & Birch, LLP

(57) ABSTRACT

A polyolefin porous material is produced by synthesizing silica particles, polysiloxane particles or crosslinked vinyl polymer particles having an average particle diameter of 0.01 to 0.1 μm in a molten polyolefin to obtain a polyolefin composition. The polyolefin composition is subsequently subjected to molding and stretching to obtain a polyolefin porous material. The obtained polyolefin porous material contains fine particles dispersed therein, substantially without forming agglomerates, and has an average pore diameter of 0.005 to 0.1 μm. The small pore diameter allows the material to be used as a liquid/liquid separation membrane, a base material for precision filtration, or a separator for batteries.

11 Claims, No Drawings

PROCESS FOR THE PRODUCTION OF POROUS POLYOLEFIN

This application is the national phase under 35 U.S.C. §371 of PCT International Application No. PCT/JP98/01100 which has an International filing date of Mar. 16, 1998 which designated the United States of America.

TECHNICAL FIELD

The present invention relates to a process for producing a polyolefin porous material. More specifically, it relates to a process for producing a polyolefin porous material with a large number of interconnecting pores having an extremely small diameter.

BACKGROUND ART

As one of processes for producing a polyolefin porous material, there is known a process for forming a large number of micropores which comprises stretching the mixture of a filler and a polyolefin to promote interfacial separation between the polyolefin and the filler and further fibrillating through the cleavage of a polyolefin phase. This process is excellent because a polyolefin porous material can be easily obtained.

For example, the present inventors have already proposed a process for producing a microporous polyolefin sheet by biaxially stretching a polyolefin sheet made from a polyolefin highly filled with a filler such as calcium carbonate or polymethyl sylsesquioxane [see Ind. Eng. Chem. Res., 32, 221 (1993)].

In the above process, the properties of the obtained microporous polyolefin sheet are determined by the type, particle diameter and amount of the filler and a stretch ratio. To obtain a microporous sheet having a smaller pore diameter, it is desirable to use a smaller filler. However, the characteristic feature of powders is such that the smaller the diameter of particles, the higher the cohesiveness of the particles become. Therefore, when a filler having a small particle diameter is blended into a polyolefin, it is difficult to disperse primary particles uniformly and the formation of agglomerates is inevitable. As a result, the size of the agglomerates affects the formation of amicroporous structure, thereby causing an increase in pore diameter and the expansion of a pore diameter distribution. Therefore, it is difficult to produce a microporous sheet having a very small pore diameter and a large pore specific surface area.

Also, the present inventors have already proposed microporous polyolefin fibers (see J. Appl. Polym. Sci. 61 2355 (1996), ibid 62 81 (1996), JP-A 7-289829, JP-A 9-157943 and JP-A 9-157944). They are microporous fibers obtained by melt-spinning and stretching a polyolefin composition containing an appropriate amount of a filler. In these microporous fibers, at least 15 wt % of a filler is required to form pores thoroughly.

In order to enhance the adsorptivity of a microporous fiber, it is desirable to decrease the diameter of pores formed in the fiber and to increase the specific surface area of each pore. Therefore, it is desirable to use a filler having as small a diameter as possible. When a filler having an average particle diameter of less than 0.1 $\mu$m is used, there arises a problem such as the agglomeration of particles. This agglomeration problem becomes more serious as the amount of the filler increases as described above. When a large number of agglomerates are formed, the size of the agglomerates affects the formation of a microporous structure, thereby causing the expansion of a pore diameter distribution and making it difficult to obtain a microporous fiber which satisfies the above requirements. Further, a high-strength microporous fiber cannot be obtained owing to the agglomerates.

DISCLOSURE OF THE INVENTION

Under the circumstances, it is an object of the present invention to produce a polyolefin porous material having a large total pore specific surface area and pores with an extremely small average diameter without forming the agglomerates of particles in a process for producing a polyolefin porous material, which comprises blending a filler with a polyolefin, stretching the mixture to cause interfacial separation between a polyolefin phase and particles, and fibrillating through the cleavage of the polyolefin phase to form micropores. Other objects and advantages of the present invention will become apparent from the following description.

According to the present invention, the above objects and advantages of the present invention are attained by a process for producing a polyolefin porous material, which comprises the steps of:

synthesizing very fine particles having an average particle diameter of 0.01 to 0.1 $\mu$m in a polyolefin to obtain a polyolefin composition; and molding and stretching the obtained polyolefin composition.

Known polyolefins are used without particular restriction as the polyolefin used in the present invention. Illustrative examples of the polyolefin include homopolymers of $\alpha$-olefins such as polyethylene, polypropylene, polybutene-1 and polymethyl pentene, copolymers of $\alpha$-olefins and other copolymerizable monomers, and mixtures thereof. Of these, in view of the heat resistance and moldability of the obtained polyolefin porous material, propylene homopolymers, copolymers of propylene and other copolymerizable monomers, and mixtures thereof are preferable.

The copolymers of $\alpha$-olefins and other copolymerizable monomers are preferably a copolymer which contains an $\alpha$-olefin, particularly propylene, in an amount of 90 wt % or more and other copolymerizable monomers in an amount of 10 wt % or less. Known copolymerizable monomers may be used without particular restriction as the above copolymerizable monomer. Of these, $\alpha$-olefins having 2 to 8 carbon atoms are preferable, and ethylene and butene are particularly preferable.

When a polypropylene homopolymer, a copolymer of propylene and other copolymerizable monomer or a mixture thereof is used out of these, the obtained polyolefin porous material has excellent transparency advantageously.

In the process of the present invention, a specific method for synthesizing fine particles in a polyolefin comprises mixing water with an alkoxysilane in a molten polyolefin to hydrolyze the alkoxysilane. The alkoxysilane is preferably a compound represented by the following general formula:

$$R_xSi(OR')_y$$

wherein R and R' are substituted or unsubstituted alkyl groups, x is an integer of 0 to 3, y is an integer of 1 to 4, and the total of x and y is 4.

The alkyl group is preferably a group having 1 to 4 carbon atoms such as a methyl group, ethyl group, propyl group or butyl group, more preferably a group having 1 to 2 carbon atoms such as a methyl group or ethyl group. Preferable examples of the alkoxysilane include tetraalkoxysilanes such as tetramethoxysilane and tetraethoxysilane; trialkoxysilanes having one alkyl group such as methyltriethoxysilane and ethyltrimethoxysilane; dialkoxysilanes having two alkyl groups such as diethoxysilane; and monoalkoxysilanes having three alkyl groups such as trimethylmethoxysilane. Further, compounds having a substituted alkyl group may be used in conjunction with these compounds. They may be used independently or as a properly prepared admixture.

When a molten polyolefin containing such analkoxysilane is mixed with water, the alkoxysilane is hydrolyzed to form the skeleton of a —Si—O— bond, thereby causing phase separation in the molten polyolefin to form fine particles. Since the diffusion speed of the alkoxysilane in the molten polyolefin composition is very low, the amount of the alkoxysilane concentrated at the reaction point of hydrolysis is limited. As a result, the particle diameter of the formed silica particles or polysiloxane particles is extremely small, and at the same time, the formation of agglomerates can be nearly perfectly suppressed. Therefore, silica particles or polysiloxane particles having an average particle diameter of 0.01 to 0.1 $\mu$m can be easily formed with the particles uniformly dispersed in the polyolefin composition after the reaction, and a polyolefin porous material can be favorably obtained by molding and stretching this polyolefin composition.

In the above production process, a kneader or extruder is preferably used to melt-kneading the polyolefin with the alkoxysilane. There is particularly preferably used an extruder to which additives can be fed in the step of extruding a supplied resin while the resin is melt-kneaded with a screw, such as an extruder to which additives can be side-fed from two intermediate locations. To melt the polyolefin using the extruder, the alkoxysilane is first fed from a side feed port at an upstream and then mixed with the polyolefin well, and water is fed from a side feed port at a downstream and mixed with these and further mixed well. Alternatively, an extruder having one side feed port may be used to melt-mix the polyolefin with the alkoxysilane, and the obtained composition may be supplied to the extruder again to mix it with water.

In general, the melt-mixing temperature is preferably 160 to 200° C. The feed of the alkoxysilane is generally 100 to 500 ml based on 1 kg of the polyolefin in the case of tetraethoxysilane.

In the process using the above extruder, there is a case where the amount of the alkoxysilane to be mixed homogeneously with the polyolefin by a single extrusion step cannot be so large. Therefore, to achieve the content of fine particles required to form desired micropores, an extruded product is repeatedly supplied to an extruder to melt-mix the alkoxysilane and water, if a single extrusion process is inadequate.

To carry out a hydrolysis reaction more smoothly in the above production process, the reaction is preferably carried out in the presence of a basic compound. Any basic compounds having catalytic activity for the hydrolysis reaction may be used without restriction. Illustrative examples of the basic compound include quaternary ammonium bases such as ammonia, tetramethyl ammonium hydroxide and tetraethyl ammonium hydroxide; aliphatic amines such as trimethylamine; and carboxylates of the groups 1 and 2 of the periodic table such as magnesium stearate and calcium stearate, and mixtures thereof. Of these, magnesium stearate and calcium stearate are particularly preferable. The amount of the basic compound is 0.01 to 10 parts by weight, preferably 0.05 to 5 parts by weight, based on 100 parts by weight of the polyolefin.

The amount of water is preferably ½ mol or more per mol of the alkoxysilane in view of hydrolysis reaction efficiency.

After the above hydrolysis reaction, the cooled polyolefin composition is generally dried at 100 to 120° C. for 1 to 24 hours using an ordinary drier.

In the present invention, to synthesize fine particles in the polyolefin, a pelletized mixture of the polyolefin and the alkoxysilane may be immersed in water containing the basic compound to hydrolyze the alkoxysilane.

Alternatively, a vinyl monomer may be polymerized with a crosslinking agent in a molten polyolefin to synthesize fine particles in the molten polyolefin. Thereby, the vinyl monomer and the crosslinking agent are polymerized while forming crosslinking to synthesize crosslinked vinyl polymer particles. At this point, the vinyl monomer and the crosslinking agent are compatible with the molten polyolefin, while the formed polymer radical is incompatible with and phase-separated from the polyolefin. In addition, the phase separation is promoted by the use of the crosslinking agent. Further, the diffusion speed of the vinyl monomer and the crosslinking agent in the molten polyolefin, which is very viscous, is very low, the growth of the polymer radical derived from a radical polymerization initiator is restricted, and it is conceivable that the polymer radical itself is trapped in the crosslinked polymer. As a result, the formed crosslinked vinyl polymer particles have a small average particle diameter of 0.01 to 0.1 $\mu$m and are well dispersed in the polyolefin composition without substantially forming agglomerates. Because the monomer and the cross linking agent are radically polymerized in the polymer, the above crosslinked vinyl polymer particles may possibly be formed by graft polymerization. However, its details are unknown.

In the present invention, known vinyl monomers having a vinyl group may be used without particular restriction. Illustrative examples of the vinyl monomer include aromatic monomers such as styrene and vinyl toluene; acrylate-based monomers such as alkyl acrylates, alkyl methacrylates, glycidyl acrylates, glycidyl methacrylates, ethylene glycol diacrylates and ethylene glycol dimethacrylates; maleimide-based monomers such as N-phenylmaleimide and N-alkylmaleimide, and maleic anhydride. They may be used alone or in admixture. The alkyl group of the monomer preferably has 1 to 5 carbon atoms.

Although divinylbenzene is the most popular crosslinking agent, known crosslinking agents such as 1,1'-styrylethane, 1,2-distyrylethane, trivinylbenzene and ethylene glycol dimethacrylate maybe used without restriction. A combination of a polyolefin and a vinyl monomer is selected after confirmed experimentally in view of compatibility and heat stability to a temperature required for melt kneading. The crosslinking agent may be used alone as the vinyl monomer.

An ordinary radical polymerization initiatormay be used as the radical polymerization initiator used for the polymerization of the vinyl monomer. It may be selected in view of polymerization temperature, that is, the melt-kneading temperature of the polymer. Illustrative examples of the radical polymerization initiator include dicumyl peroxide, t-butyl peroxide, di-t-butyl peroxide and diisopropylbenzene hydroperoxide.

In the above process, the amounts of the vinyl monomer and the crosslinking agent are preferably 1 to 10 parts by weight based on 100 parts by weight of the polyolefin. The mixing ratio of the crosslinking agent to the vinyl monomer is not particularly limited but is preferably 0.03 or more, more preferably 0.03 to 15. The mixing ratio of the radical polymerization initiator to the total of the crosslinking agent and the vinyl monomer is preferably 0.005 to 0.05, more preferably 0.01 to 0.05.

A kneader or an extruder is preferably used to melt-knead the polyolefin with the vinyl monomer, the crosslinking agent and the radical polymerization initiator. In general, the temperature at which the fed polymer is extruded while melt-kneaded with a screw is preferably 160 to 250° C.

In the present invention, the polyolefin composition having fine particles dispersed therein without substantially forming agglomerates, which is obtained by the above process, is molded and stretched.

In the present invention, the obtained polyolefinporous material can be advantageously used for practical application when it is in the form of a film or fiber. Therefore, how to mold the polyolefin porous material into a film or fiber will be described in details hereinafter.

To obtain the polyolefin porous material of the present invention in the form of a film, the above polyolefin composition is molded into a sheet, which is then stretched. In general, known inflation molding or known extrusion molding using a T die is preferably employed to mold the polyolefin composition into a sheet. For example, a 20 to 85-mm-diameter extruder equipped with a T die with a die lip interval of 0.1 to 1 mm and a width of 10 to 1,000 mm is used to mold the polyolefin composition into a sheet at 200 to 250° C.

The obtained sheet is further stretched monoaxially with rolls, stretched monoaxially first and then biaxially in a traverse direction with a tenter or mandrel, or stretched in both longitudinal and transverse directions simultaneously.

The stretch ratio of the sheet in the present invention is not particularly limited but is generally at least 1.5 to 7 times in a monoaxial direction. It is particularly preferable that the sheet be stretched in longitudinal and transverse directions with an area stretch ratio of 1.5 to 30 times. If the stretch ratio is too small, the formation of micropores is not satisfactory and the total pore specific surface area is small. On the other hand, if the stretch ratio is too large, the sheet is frequently broken at the time of stretching, thereby increasing the occurrence of troubles in production.

The stretching temperature is generally from normal temperature to the melting point of the polyolefin, particularly preferably a temperature 10 to 100° C. lower than he melting point. If the stretching temperature is higher than a temperature 10° C. lower than the melting point of the polyolefin, there is such a tendency that the number of formed micropores is decreased while stretching is done with ease, and further, the formed micropores may be crushed by heat. Conversely, if the stretching temperature is lower than a temperature 100° C. higher than the melting point of the polyolefin, the above stretch ratio is hardly achieved and the frequency of breaking increases.

The film obtained by stretching as described above is preferably heated under tension, for example, heat-set at a temperature higher than the above stretching temperature and lower than the melting point and cooled to room temperature to obtain an object. To improve adhesion, the film is preferably subjected to a surface treatment such as a corona discharge treatment, hydrophilization treatment or hydrophobilization treatment.

To obtain the polyolefin porous material of the present invention in the form of a fiber, its molding method is not particularly limited but known extrusion molding is preferably employed that uses an extruder equipped with a nozzle for producing fibers which has one or many small holes.

The obtained fibrous material is generally stretched by monoaxial stretching, making use of the difference of rotation speed ratio between a pair of Nelson rolls or godet rolls.

The stretch ratio for obtaining fibers is not particularly limited but is generally3 to 20 times, preferably 5 to 15 times. By employing the above stretch ratio, the formation of micropores in particular becomes satisfactory and there can be produced a fiber having a large total pore specific surface area and excellent adsorptivity. Such a trouble as fiber breakage at the time of stretching rarely occurs.

The stretching temperature and the heat treatment under tension after stretching are the same as those in the case of producing a film.

By the above process, there can be obtained a polyolefin porous material, which is made from a polyolefin composition having fine particles with an average particle diameter of 0.01 to 0.1 $\mu$m dispersed therein without substantially forming agglomerates, which has communicating pores with an average pore diameter of 0.005 to 0.1 $\mu$m, a porosity of 1 to 60%, a total pore specific surface area of 20 to 300 $m^2/g$ and which is produced by fibrillating through the cleavage of a polyolefin phase.

The fine particles are dispersed in the polyolefin without substantially forming agglomerates. If the proportion of agglomerates, each of which consists of two or more fine particles, is 5% or less, preferably 3% or less, more preferably 1% or less, the fine particles are accepted as being substantially not agglomerated in the present invention.

The content of the fine particles contained in the polyolefin porous material is 1 to 30 parts by weight, preferably 1 part by weight or more and less than 15 parts by weight, more preferably 3 to 10 parts by weight, based on 100 parts by weight of the polyolefin, in order to obtain a porous material with a high porosity. The amount of the fine particles contained in the polyolefin porous material can be obtained from an ash content measured by placing the polyolefin porous material in a magnetic crucible and ashing it in an electric furnace at 600° C. for 1 hour or from the result of fluorescent X-ray analysis, when the fine particles are silica particles or polysiloxane particles. The amount of the fine particles can be obtained from the infrared absorption spectrum of the polyolefin porous material, when the fine particles are crosslinked vinyl polymer particles.

The polyolefin porous material obtained in the present invention and having the form of a film or fiber can be particularly advantageously used. In the case of a film, the thickness of the film is not particularly limited but is generally 2 to 100 μm, preferably 5 to 25 μm. In the case of a fiber, the diameter of the fiber is not particularly limited but is preferably 10 to 30 μm.

As described above, according to the present invention, the agglomerates of fine particles are not formed, and consequently, pores having an extremely small average pore diameter are formed even with a relatively small amount of a filler, and a polyolefin porous material having a large total pore specific surface area can be produced.

The polyolefin porous material obtained by the process of the present invention is made from a polyolefin having excellent heat resistance, chemical resistance and strength and has a small average pore diameter of 0.005 to 0.1 μm, a porosity of 1 to 60% and a large total pore specific surface area of 20 to 300 $m^2/g$. It also has large elongation and high breaking strength, in addition to high adsorptivity of an organic solvent.

Therefore, the polyolefin porous material obtained in the present invention is advantageously used as an super-precision air filter for removing dust or germs; disposal of waste water; production of clean water in the food industry, electronic industry and pharmaceutical industry; a material for a cartridge filter used for liquid/liquid separation and the like; a base material for precision filtration or ultrafiltration; and a separator for a battery. Further, it is conceivable that it may be used as a fiber for air-permeable apparel, filter cloth or non-woven cloth, in view of its large total pore specific surface area.

EXAMPLES

The following examples and comparative examples are provided for the purpose of further illustrating the present invention but are in no way to be taken as limiting. The physical properties of polyolefin porous materials shown in the examples and comparative examples were measured in accordance with the following methods.

(1) average particle diameter of fine particles; This is obtained by measuring the diameters of all the particles seen in a 5×5 μm view field of a photo of the surface of a polyolefin porousmaterial takenbythehigh-resolution scanning electron microscope of JEOL Ltd.

(2) average pore diameter (μ); measured in accordance with mercury press-in porosimetry using the Pore Sizer 9310 of Shimadzu Corporation.

(3) total pore specific surface area ($m^2/g$); measured in accordance with mercury press-in porosimetry using the Pore Sizer 9310 of Shimadzu Corporation.

(4) porosity (%); measured in accordance with mercury press-in porosimetry using the Pore Sizer 9310 of Shimadzu Corporation.

(5) diameter (μm); measured using the Micro Hi-scope System DH-2200 of Hyrox Co., Ltd.

(6) denier (g/9000 m); the weight of a fiber per 9,000 m in length.

(7) elongation (%); measured at a sample length of 100 mm and a pulling speed of 300%/min using the tensile tester Autograph 200 of Shimadzu Corporation.

(8) breaking strength (g/d); measured at a sample length of 100 mm and a pulling speed of 300%/min using the Autograph 200 of Shimadzu Corporation.

(9) Young's modulus (g/d); measured at a sample length of 100 mm and a pulling speed of 300%/min using the Autograph 200 of Shimadzu Corporation.

(10) amount of adsorption; One gram of fibers is immersed in a mixed solution of isopropyl alcohol (reagent) and distilled water in a ratio of 1:1 for one hour, and the amount of a solution adsorbed by the fibers was calculated from a change in the weight of the solution. When the adsorbed solutions were examined in the tests of examples and comparative examples, it was confirmed that they were mostly isopropyl alcohol and that the isopropyl alcohol was selectively adsorbed by the fibers.

(11) $N_2$ gas permeability ($l/m^2$ min); measured using the automatic precision membrane flow meter SF-1100 of Estec Co., Ltd.

(12) haze; measured using the haze computer GM-2DP of Suga Shikenki Co., Ltd.

Example 1

Tetraethoxysilane was blended with polypropylene (MFI=1.2 g/10 min) using a twin-screw extruder at 200° C. and the resulting blend was granulated. The tetraethoxysilane was press-injected into the extruder using the HYM-03 plunger pump of Fuji Techno Kogyo Co., Ltd. The balance between the rotation speed of a screw and injection speed was adjusted so that the tetraethoxysilane was added in an amount of 250 ml based on 1 kg of the polypropylene. The phase separation of the granulated pellets from the tetraethoxysilane did not take place even at room temperature.

Further, the pellets were hydrolyzed at 160 to 200° C. by press-injecting a 0.2% aqueous solution of tetraethyl ammonium hydroxide in place of tetraethoxysilane using the same extruder. The ash content of each of the obtained pellets was 2.7%.

The obtained pellets were molded into a sheet by an extruder equipped with a T die at 230° C., and the sheet was biaxially stretched at 145° C. by the small-sized biaxial stretching device of Shibayama Kagaku Seisakusho Co., Ltd.

When the surface of the obtained microporous film was observed under the high-resolution scanning electron microscope of JEOL Ltd., fine particles were uniformly dispersed and agglomerates did not exist. The properties of the film were as follows.

average particle diameter of fine particles; 0.02 μm stretch ratio; 3×3 porosity; 9% average pore diameter; 0.01 μm total pore specific surface area; 140 $m^2/g$
quantity of permeated $N_2$ gas; 33 l/min·$m^2$
($N_2$ pressure; 0.5 kg/$cm^2$) haze; 15

Example 2

A hundred fifty grams of magnesium stearate and 2.5 liters of tetraethoxysilane were mixed with 10 kg of polypropylene (MFI=1.5 g/10 min), and the resulting mixture was granulated with an extruder. The obtained pellets were hydrolyzed in the same manner as in Example 1 and pelletized. The ash content of each of the obtained dry pellets was 1.3%.

The pellets were molded into a sheet in the same manner as in Example 1, and the sheet was biaxially stretched to give a microporous film having transparency. When the surface of the obtained microporous film was observed, fine particles were uniformly dispersed and agglomerates did not exist. The properties of the film were as follows.

average particle diameter of fine particles; 0.022 μm
stretch ratio; 5×5
porosity; 15%
average pore diameter; 0.01 μm
total pore specific surface area; 114 $m^2/g$
quantity of permeated $N_2$ gas; 98 l/min·$m^2$
($N_2$ pressure; 0.5 kg/$cm^2$) haze; 22

Example 3

The amount shown in Table 1 below of calcium stearate was mixed with 2 kg of polypropylene (MFI=1.5 g/10 min). After the mixture was injected into an extruder, tetraethoxysilane was added to the mixture from the intermediate position of the extruder by a plunger pump in an amount of 0.25 liter based on 1 kg of the polypropylene. The resulting mixture was granulated. The obtained pellets were hydrolyzed in the same manner as in Example 2 and pelletized. The ash content of each of the obtained dry pellets is shown in Table 1.

The pellets were molded into a sheet in the same manner as in Example 1, and the sheet was biaxially stretched with the Pantograph-type biaxial stretching device of Brückner Co., Ltd. to give a microporous film having transparency and gas permeability. When the surface of the obtained microporous film was observed, fine particles were uniformly dispersed and agglomerates did not exist. The properties of the film are shown in Table 1.

TABLE 1

| | | | | |
|---|---|---|---|---|
| quantity of calcium stearate (g) | 20 | 30 | 40 | 50 |
| ash content (%) | 2.21 | 2.61 | 2.79 | 3.35 |
| average particle diameter of fine particles (μm) | 0.02 | 0.02 | 0.025 | 0.029 |
| stretch ratio (times) | 3.5 × 3.5 | 5 × 5 | 3 × 3 | 4.2 × 4.2 |
| porosity (%) | 8.35 | 13.3 | 15.0 | 19.1 |
| average pore diameter (μm) | 0.01 | 0.02 | 0.02 | 0.02 |
| total pore specific surface area ($m^2/g$) | 114 | 161 | 177 | 189 |
| quantity of permeated $N_2$ gas (1/min · $m^2$) ($N_2$ pressure; 0.5 kg/$cm^2$) | 31 | 104 | 120 | 250 |
| haze | 16 | 18 | 21 | 24 |

Example 4

Two hundred grams of calcium stearate and 2.5 liters of tetraethoxysilane were mixed with 10 kg of polypropylene (MFI=1.5 g/10 min) and the resulting mixture was granulated with an extruder. The obtained pellets were hydrolyzed in the same manner as in Example 2andpelletized. The ash content of each of the obtained dry pellets was 4.3%.

The pellets were molded into a sheet in the same manner as in Example 1, and the sheet was biaxially stretched to give a microporous film. When the surface of the obtained microporous film was observed, fine particles were uniformly dispersed and agglomerates did not exist. The properties of the film were as follows.

average particle diameter of fine particles; 0.042 μm
stretch ratio; 7×7
porosity; 26%
average pore diameter; 0.06 μm
total pore specific surface area; 135 $m^2/g$
quantity of permeated $N_2$ gas; 198 l/min·$m^2$
($N_2$ pressure; 0.5 kg/$cm^2$) haze; 33

Example 5

A hundred twenty five grams of calcium stearate was added to and mixed with 5 kg of polypropylene (MFI=1.5 g/10 min), methyltriethoxysilane was melt-kneaded with the mixture at 160 to 190° C. in the same manner as in Example 2, and water was further press-injected at 200° C. to subject the resulting mixture to hydrolysis. The ash content of each of the obtained dry pellets was 5.4%.

The pellets were molded into a sheet in the same manner as in Example 1, and the sheet was biaxially stretched to give a microporous film having transparency. When the surface of the obtained microporous film was observed, fine particles were uniformly dispersed and agglomerates did not exist. The properties of the film were as follows.

average particle diameter of fine particles; 0.03 μm
stretch ratio; 5×5
porosity; 17%
average pore diameter; 0.02 μm
total pore specific surface area; 194 $m^2/g$
quantity of permeated $N_2$ gas; 108 l/min·$m^2$
($N_2$ pressure; 0.5 kg/$cm^2$) haze; 16

Example 7

Ten kilograms of polypropylene (MFI=1.2 g/10 min), 460 g of glycidyl methacrylate, 40 g of a divinylbenzene crosslinking agent, and 11.5 g of 1,1-bis(t-butylperoxy) cyclohexane as a radical polymerization initiator were stirred and mixed together with a super mixer. The obtained mixture was polymerized at 230° C. using a twin-screw extruder and granulated to give pellets. The pellets were post-polymerized in a $N_2$ atmosphere at 80° C. for one night.

The obtained pellets were molded into a sheet with an extruder equipped with a T die at 230° C., and the sheet was biaxially stretched at 145° C. by the small-sized biaxial stretching device of Shibayama Kagaku Seisakusho Co., Ltd. When the surface of the obtained microporous film was observed, fine particles were uniformly dispersed and agglomerates did not exist. The properties of the film were as follows.

average particle diameter of fine particles; 0.025 μm
stretch ratio; 6×6 porosity; 13.6% average pore diameter; 0.025 μm total pore specific surface area; 138 $m^2/g$ quantity of permeated $N_2$ gas; 94 l/min·$m^2$ ($N_2$ pressure; 0.5 kg/$cm^2$) haze; 22.7

Comparative Example 1

Ten kilograms of polypropylene (MFI=1.2 g/10 min), 15 kg of calcium carbonate having a particle diameter of 3 μm, and 0.2 kg of polybutadiene having OH at a terminal as a dispersion plasticizer were mixed together with a super mixer. The obtained mixture was pelletized at 230° C. by a twin-screw extruder.

The obtained pellets were molded into a sheet by an extruder equipped with a T die at 230° C., and the sheet was stretched to 3 times in a longitudinal direction and 2 times in a transverse direction at 140° C. with a Brückner stretching device. The properties of the obtained microporous film were as follows.

stretch ratio; 3×2 porosity; 48% average pore diameter; 0.99 μm total pore specific surface area; 24 $m^2/g$ quantity of permeated $N_2$ gas; 550 l/min·$m^2$ ($N_2$ pressure; 0.5 kg/$cm^2$) haze; opaque (white color)

Comparative Example 2

Ten kilograms of polypropylene (MFI=1.2 g/10 min), 15 kg of calcium carbonate having a particle diameter of 0.083 μm, and 0.2 kg of polybutadiene having OH at a terminal as a dispersion plasticizer were mixed together with a super mixer. The obtained mixture was pelletized at 230° C. by a twin-screw extruder.

The obtained pellets were molded into a sheet by an extruder equipped with a T die at 230° C., and the sheet was stretched to 3 times in a longitudinal direction and 2 times in a transverse direction at 140° C. with a Brückner stretching device. The properties of the obtained microporous film were as follows.

stretch ratio; 3×2 porosity; 52% average pore diameter; 0.41 μm total pore specific surface area; 64 $m^2/g$ quantity of permeated $N_2$ gas; 700 l/min·$m^2$ ($N_2$ pressure; 0.5 kg/$cm_2$) haze; opaque (white color)

Example 8

Polypropylene and a basic compound shown in Table 2 were added and mixed together, and tetraethoxysilane was blended with the mixture at 200° C. by a 15-mm-diameter twin-screw extruder. The resulting mixture was granulated. The tetraethoxysilane was press-injected into the extruder using the HYM-03 plunger pump of Fuji Techno Kogyo Co., Ltd. The balance between the rotation speed of a screw and injection speed was adjusted so that the tetraethoxysilane was added in an amount of 250 ml based on 1 kg of the polypropylene. The phase separation of the granulated pellets from the tetraethoxysilane did not take place even at room temperature. The pellets were further supplied to the same extruder, and water was press-injected at 200° C. to hydrolyze the tetraethoxysilane.

The obtained pellets were extruded from a nozzle for producing fibers, which was attached to an extruder having a screw diameter of 40 mm and an L/D of 22 at 230 to 300° C. and which has 198 0.7-mm-diameter holes. This extrudate was then injected into an air cooling ring to be cooled and taken up at a rate of 200 m/min to give an unstretched fiber. This unstretched fiber was monoaxially stretched to 6 times between a pair of 7 godet rolls, one pair of which has different rotation speeds than the other pair, at 150° C. to give a microporous fiber.

When the surface of the obtained microporous fiber was observed under the high-resolution scanning electron microscope of JEOL Ltd., fine particles were uniformly dispersed and agglomerates did not exist. Conditions and the physical properties of the obtained microporous fiber are shown in Table 3.

Example 9

The operation of Example 8 was repeated to give a microporous fiber, except that a basic compound was not added when polypropylene and tetraethoxysilane were mixed together and a 0.2% aqueous solution of tetraethoxy ammonium hydroxide was press-injected in place of water.

When the surface of the obtained microporous fiber was observed, fine particles were uniformly dispersed and agglomerates did not exist. The properties of the obtained microporous fiber are shown in Table 3.

Example 10

The operation of Example 8 was repeated to give a microporous fiber, except that 150 g of magnesium stearate and 2.5 liters of tetraethoxysilane were mixed with 10 kg of polypropylene (MFI=1.5 g/10 min) and the resulting mixture was granulated with an extruder.

When the surface of the obtained microporous fiber was observed, fine particles were uniformly dispersed and agglomerates did not exist. The properties of the obtained microporous fiber are shown in Table 3.

Examples 11 to 14

The operation of Example 8 was repeated to give a microporous fiber, except that the amount of a basic compound shown in Table 2 was blended.

When the surface of the obtained microporous fiber was observed, fine particles were uniformly dispersed and agglomerates did not exist. The properties of the obtained microporous fiber are shown in Table 3.

Example 15

The operation of Example 8 was repeated to give a microporous fiber, except that diethyl diethoxysilane was used in place of tetraethoxysilane.

When the surface of the obtained microporous fiber was observed, fine particles were uniformly dispersed and agglomerates did not exist. The properties of the obtained microporous fiber are shown in Table 3.

TABLE 2

| No. | polypropylene (parts by weight) | basic catalyst type | basic catalyst parts by weight * | alkoxysilane type | alkoxysilane parts by weight * | ash content (amount of silica super fine particles) wt % |
|---|---|---|---|---|---|---|
| Ex. 8 | 100 | magnesium stearate | 2.5 | tetraethoxysilane | 23.4 | 1.8 |
| Ex. 9 | 100 | magnesium stearate | 2.5 | tetraethoxysilane | 23.4 | 2.1 |
| Ex. 10 | 100 | magnesium stearate | 1.5 | tetraethoxysilane | 23.4 | 1.2 |
| Ex. 11 | 100 | calcium stearate | 1.0 | tetraethoxysilane | 23.4 | 2.21 |
| Ex. 12 | 100 | calcium stearate | 1.5 | tetraethoxysilane | 23.4 | 2.61 |
| Ex. 13 | 100 | calcium stearate | 2.0 | tetraethoxysilane | 23.4 | 2.79 |
| Ex. 14 | 100 | calcium stearate | 2.5 | tetraethoxysilane | 23.4 | 3.35 |
| Ex. 15 | 100 | calcium stearate | 2.5 | diethyldiethoxysilane | 23.4 | 5.4 |

Ex.: Example
* based on 100 parts by weight of polypropylene

TABLE 3

| No. | take-up rate (m/min) | stretch ratio (times) | diameter of fiber ($\mu$m) | average pore diameter ($\mu$m) | total pore specific surface area ($m^2/g$) |
|---|---|---|---|---|---|
| Example. 8 | 200 | 6 | 20 | 0.018 | 108 |
| Example. 9 | 200 | 6 | 20 | 0.018 | 114 |
| Example. 10 | 200 | 5 | 23 | 0.01 | 109 |
| Example. 11 | 200 | 6 | 18 | 0.01 | 107 |
| Example. 12 | 200 | 6 | 18 | 0.02 | 101 |
| Example. 13 | 200 | 6 | 20 | 0.02 | 147 |
| Example. 14 | 200 | 6 | 21 | 0.02 | 179 |
| Example. 15 | 200 | 6 | 21 | 0.02 | 199 |

| No. | porosity (%) | elongation (%) | breaking strength (g/d) | Young's modulus (g/d) | amount of adsorption per gram of fibers (g) |
|---|---|---|---|---|---|
| Example. 8 | 5.4 | 20 | 10.4 | 111 | 2.2 |
| Example. 9 | 5.5 | 21 | 11.0 | 104 | 3.6 |
| Example. 10 | 5.4 | 20 | 11.2 | 110 | 2.3 |
| Example. 11 | 5.4 | 20 | 10.6 | 109 | 2.8 |
| Example. 12 | 7.3 | 19 | 10.1 | 110 | 3.4 |
| Example. 13 | 11 | 21 | 9.6 | 107 | 3.9 |
| Example. 14 | 13 | 18 | 9.0 | 98 | 4.5 |
| Example. 15 | 15 | 15 | 8.4 | 91 | 5.5 |

Examples 16 to 19

A composition comprising polypropylene, vinyl monomer, crosslinking agent and radical polymerization initiator shown in Table 4 was mixed with a super mixer for 5 minutes and extruded into a strand with a twin-screw extruder at 200° C., and the strand was cut into pellets. The obtained pellets were extruded from a nozzle for producing fibers, which was attached to an extruder having a screw diameter of 40 mm and an L/D of 22 and which has 198 0.7-mm-diameter holes. This extrudate was then injected into an air cooling ring to be cooled and taken up at a rate of 200 m/min to give an unstretched fiber. This unstretched fiber was monoaxially stretched to 10 to 12 times between a pair of 7 godet rolls, one pair of which has different rotation speeds than the other pair, at 150° C. to give a microporous fiber. When the surface of the obtained microporous fiber was observed, fine particles were uniformly dispersed and agglomerates did not exist. The properties of the obtained microporous fiber are shown in Table 5.

TABLE 4

| No. | polypropylene (parts by weight) | vinyl monomer type | vinyl monomer parts by weight * | crosslinking agent type | crosslinking agent parts by weight * | radical polymerization initiator type | radical polymerization initiator parts by weight * |
|---|---|---|---|---|---|---|---|
| Ex. 16 | 100 | glycidyl methacrylate | 4.6 | divinylbenzene | 0.4 | di-t-butyl peroxide | 0.05 |
| Ex. 17 | 100 | ethylene glycol dimethacrylate | 5.0 | divinylbenzene | 0.4 | di-t-butyl peroxide | 0.05 |
| Ex. 18 | 100 | ethylene glycol dimethacrylate/ maleic anhydride = 1/1 | 5.0 | divinylbenzene | 0.4 | di-t-butyl peroxide | 0.05 |
| Ex. 19 | 100 | glycidyl methacrylate/ N-phenylmaleimide = 4/1 | 7.0 | divinylbenzene | 0.7 | di-t-butyl peroxide | 0.07 |

Ex.: Example
* based on 100 parts by weight of polypropylene

TABLE 5

| No. | take-up rate (m/min) | stretch ratio (times) | diameter of fiber (μm) | average pore diameter (μm) | total pore specific surface area ($m^2$/g) |
|---|---|---|---|---|---|
| Example. 16 | 200 | 11 | 13 | 0.02 | 107 |
| Example. 17 | 200 | 10 | 16 | 0.01 | 109 |
| Example. 18 | 200 | 11 | 11 | 0.01 | 199 |
| Example. 19 | 200 | 12 | 14 | 0.01 | 200 |

| No. | porosity (%) | elongation (%) | breaking strength (g/d) | Young's modulus (g/d) | amount of adsorption per gram of fibers (g) |
|---|---|---|---|---|---|
| Example. 16 | 20.3 | 15 | 15.4 | 121 | 3.2 |
| Example. 17 | 19.0 | 16 | 16.0 | 114 | 3.6 |
| Example. 18 | 20.3 | 15 | 16.2 | 120 | 5.0 |
| Example. 19 | 20.6 | 15 | 16.6 | 119 | 5.2 |

TABLE 5-continued

Comparative Example 3

Ten kilograms of polypropylene (MFI=1.2 g/10 min), 15 kg of calcium carbonate having a particle diameter of 3 μm, and 0.2 kg of polybutadiene having OH at a terminal as a dispersion plasticizer shown in Table 6 were mixed together with a super mixer, and the resulting mixture was pelletized at 230° C. using a twin-screw extruder. An unstretched fiber was molded of the obtained pellets and stretched monoaxially in the same manner as in Example 8 to give a microporous fiber.

When the surface of the obtained microporous fiber was observed, fine particles were partly agglomerated. The properties of the obtained microporous fiber are shown in Table 7.

Comparative Example 4

Ten kilograms of polypropylene (MFI=1.2 g/10 min), 15 kg of calcium carbonate having a particle diameter of 0.08 μm, and 0.2 kg of polybutadiene having OH at a terminal as a dispersion plasticizer shown in Table 6 were mixed together with a super mixer, and the resulting mixture was pelletized at 230° C. using a twin-screw extruder. An unstretched fiber was molded of the obtained pellets and stretched monoaxially in the same manner as in Example 8 to give a microporous fiber.

When the surface of the obtained microporous fiber was observed, there were agglomerates, consisting of 10 particles on the average, in a proportion of about 60% in addition to fine particles dispersed solely. The properties of the obtained microporous fiber are shown in Table 7.

Comparative Example 5

An unstretched fiber was obtained using polypropylene pellets (MFI=1.2 g/10 min) in the same manner as in Example 8 and monoaxially stretched in the same manner as in Example 8 to give a fiber. The properties of the obtained fiber are shown in Table 7.

TABLE 6

| No. | polypropylene parts by weight | filler type | filler particle diameter (μm) | filler parts by weight * | dispersion plasticizer type | dispersion plasticizer parts by weight * |
|---|---|---|---|---|---|---|
| C. Ex. 3 | 100 | calcium carbonate | 3 | 150 | polybutadiene having OH at terminal | 1.3 |
| C. Ex. 4 | 100 | calcium carbonate | 0.08 | 150 | polybutadiene having OH at terminal | 1.3 |
| C. Ex. 5 | 100 | — | — | — | — | — |

C.Ex.: Comparative Example
* based on 100 parts by weight of filler

TABLE 7

| No. | take-up rate (m/min) | stretch ratio (times) | diameter of fiber (μm) | average pore diameter (μm) | total pore specific surface area ($m^2$/g) |
|---|---|---|---|---|---|
| Comp. Ex. 3 | 200 | 5 | 24 | 0.3 | 8 |
| Comp. Ex. 4 | 200 | 6 | 25 | 0.03 | 36 |
| Comp. Ex. 5 | 200 | 6 | 19 | — | 0.2 |

| No. | porosity (%) | elongation (%) | breaking strength (g/d) | Young's modulus (g/d) | amount of adsorption per gram of fibers (g) |
|---|---|---|---|---|---|
| Comp. Ex. 3 | 11 | 3 | 1.1 | 18 | 0.8 |
| Comp. Ex. 4 | 12 | 19 | 1.8 | 18 | 2.1 |
| Comp. Ex. 5 | — | 22 | 12 | 115 | 0.5 |

Comp.Ex.: Comparative Example

What is claimed is:

1. A process for producing a polyolefin porous product, comprising the steps of:

synthesizing fine particles having an average particle diameter of 0.01 to 0.1 μm in a molten polyolefin to give a polyolefin composition, said fine particles being silica particles or polysiloxane particles obtained by hydrolysis of an alkoxysilane in said molten polyolefin or being crosslinked vinyl polymer particles obtained by polymerization of a vinyl monomer and a crosslinking agent in said molten polyolefin;

molding the obtained polyolefin composition; and stretching the molded product to produce a polyolefin porous product.

2. The process of claim 1, wherein the fine particles are silica particles, polysiloxane particles or crosslinked vinyl polymer particles.

3. The process of claim 1, wherein the alkoxysilane is a compound represented by the following formula:

$$RxSi(OR')y$$

wherein R and R' are each a substituted or unsubstituted alkyl group, x is an integer of 0 to 3, y is an integer of 1 to 4, and the total of x and y is 4.

4. The process of claim 1, wherein the vinyl monomer is an aromatic monomer, acrylate monomer, maleimide monomer or maleic anhydride.

5. The process of claim 1, wherein the polyolefin porous composition contains 1 to 30 parts by weight of the fine particles based on 100 parts by weight of the polyolefin.

6. The process of claim 1, wherein the polyolefin porous composition contains 1 part by weight or more and less than 15 parts by weight of the fine particles based on 100 parts by weight of the polyolefin.

7. The process of claim 1, wherein the polyolefin is a propylene homopolymer, a copolymer of 90 wt % or more of propylene and 10 wt % or less of an α-olefin having 2 to 8 carbon atoms, or a mixture thereof.

8. The process of claim 1, wherein the fine particles having an average particle diameter of 0.01 to 0.1 μm are synthesized in a molten polyolefin.

9. The process of claim 7, wherein the polyolefin is molten at 160 to 200° C.

10. The process of claim 1, wherein the polyolefin composition is molded into a sheet or a fiber.

11. The process of claim 1, wherein the polyolefin porous product is a film or a fiber.

* * * * *

UNITED STATES PATENT AND TRADEMARK OFFICE

CERTIFICATE OF CORRECTION

PATENT NO. : 6,245,270 B1
DATED : June 12, 2001
INVENTOR(S) : Mizutani et al.

It is certified that error appears in the above-identified patent and that said Letters Patent is hereby corrected as shown below:

Title page,
Item [54], the title should read as follows:

-- PROCESS FOR PRODUCING A POLYOLEFIN POROUS MATERIAL --

Signed and Sealed this

Thirtieth Day of December, 2003

JAMES E. ROGAN
*Director of the United States Patent and Trademark Office*